United States Patent [19]

Lutz, III

[11] Patent Number: 4,888,926

[45] Date of Patent: Dec. 26, 1989

[54] FLOOR SQUEAK ELIMINATOR

[75] Inventor: Peter J. Lutz, III, Utica, Mich.

[73] Assignee: E&E Engineering, Inc., Detroit, Mich.

[21] Appl. No.: 349,322

[22] Filed: May 8, 1989

[51] Int. Cl.[4] ..... E04G 23/00

[52] U.S. Cl. ..... 52/291; 52/483; 52/511

[58] Field of Search ..... 52/483, 291, 552, 511; 248/317, 343

[56] References Cited

U.S. PATENT DOCUMENTS

| | | | |
|---|---|---|---|
| 1,523,372 | 1/1925 | Hoerr | 52/483 X |
| 2,014,451 | 9/1935 | Pfeifer | 52/483 |
| 2,307,149 | 1/1943 | Milz | 52/483 |
| 2,345,419 | 3/1944 | Olson | 52/483 X |
| 3,017,673 | 1/1962 | Biriz | 52/483 |
| 3,456,412 | 7/1969 | Decombas | 52/483 X |

*Primary Examiner*—David A. Scherbel
*Assistant Examiner*—Jerrold D. Johnson
*Attorney, Agent, or Firm*—Krass and Young

[57] ABSTRACT

A floor squeak eliminator includes a plate assembly affixable to the underside of the floor and including a downwardly projecting threaded member. The squeak eliminator also includes a joist strap having a first end configured to engage the bottom side of a floor joist and second end configured to engage a portion of the threaded member. A nut or similar item engages the threads and draws the floor plate and joist strap together bringing the floor into contact with the subjacent joist.

9 Claims, 1 Drawing Sheet

FLOOR SQUEAK ELIMINATOR

FIELD OF THE INVENTION

This invention relates generally to building hardware and more specifically to apparatus for eliminating squeaks in flooring.

BACKGROUND OF THE INVENTION

In the construction of buildings, floors are frequently installed by supporting a deck atop a series of floor joists, which in turn are supported by an underlying foundation. The deck is usually fabricated from wood and fastened to the underlying joist by means of nails. The wooden deck may take the form of large sheets of plywood or similar material or maybe configured as a plurality of relatively narrow boards. In either instance, problems of squeaking can arise when the floor deck, for reasons of warpage, shrinkage or the like separates from the underlying joist. If this happens, the flooring "floats" above the joist and is compressed thereagainst when weight is placed on it. This compression gives a spongy feel to the floor and further more may cause squeaking particularly if the boards rub against the nail or one another. In time, repeated flexing of the deck causes further loosening of other nails and can result in still greater squeaking.

Various steps have heretofore been taken in an attempt to stop squeaking floors. The simplest approach is to drive new nails into the joist thereby fastening the squeaking board snugly thereagainst. This is impractical in situations where carpeting or tile covers the floor and is aesthetically unattractive since the exposed nail heads mar the surface of a finished floor. Furthermore, this solution does not always work, particularly if the nails is originally loosened because of a weakness or drying out in the underlying joist. In some instances, squeaks can be halted by injecting a lubricant such as graphite or talcum powder into spaces between the boards to permit them to slide without squeaking. This approach, when in works at all, cures the symptoms, but not the cause of the squeaking and does nothing to prevent a spongy floor feel or creation of new squeaks. In other instances, shims are placed between the joist and the floor to fill in the space and prevent compression of the overlying floor boards. While this approach works, it is frequently impractical insofar as access to the space between the floor and the joist is frequently limited and accordingly it is difficult to properly place the shim members.

It will be appreciated that there is a need for a means for drawing a floor deck into contact with a subjacent joist so as to eliminate squeaks and/or prevent the spongy feel associated with loose floor boards. The present invention provides such floor tightening means and furthermore is easy to use, does not mar the top surface of the floor and does not require removal of floor covering. As will be described in greater detail hereinbelow, the present invention provides a floor squeak eliminator which is affixed to the bottom surface of the floor proximate a joist and which attaches the joist and is operative to pull the floor into registry therewith.

It has previously been known to anchor items to joists; however, use of a floor joist as an anchor point for the elimination of floor squeaks has not been heretofore accomplished. U.S. Pat. No. 4,226,058 shows an anchor bolt for roof mounting of air conditioners and similar equipment, which bolt is configured to wrap around a subjacent joist to provide a base for anchoring of the equipment. This bolt however can not operate to eliminate floor squeaks and furthermore must be used in conjunction with a hole drilled through the overlying deck and hence cannot be modified to function in a manner similar to the present invention.

BRIEF DESCRIPTION OF THE INVENTION

There is disclosed herein a squeak eliminator for drawing a floor into contact with a subjacent joist. The squeak eliminator is comprised of a floor plate assembly including a generally planar member having means for affixing said planar member to the underside of the floor and further including a generally elongated member retained by said planar member and projecting approximately perpendicular therefrom. The squeak eliminator further comprises a generally hook-shaped joist strap having a first end configured to be hooked about, and retainably engaged by, a floor joist and a second end having an opening configured to have a portion of the length of the elongated member pass therethrough. The squeak eliminator still further includes attachment means operative in conjunction with the joist strap and the elongated member to retain the joist strap and the elongated member in fixed relationship and to bias the planar member and joist strap toward one another so that the floor is urged into contact with the joist thereby eliminating the squeak.

In particular embodiments, the affixing means for the floor plate may comprise a plurality of screws and the elongated member may be a carriage bolt retained by, and projecting from the plate. The joist strap may include a hook-shaped first end configured to engage the joist from the floor and may further include a second end which is generally planar and configured to be disposed parallel to the floor when the first end is engaged with the joist. The attachment means may include a threaded fastener such as a nut engagable with a threaded portion of the elongated member.

DETAILED DESCRIPTION OF THE INVENTION

Figure 1:
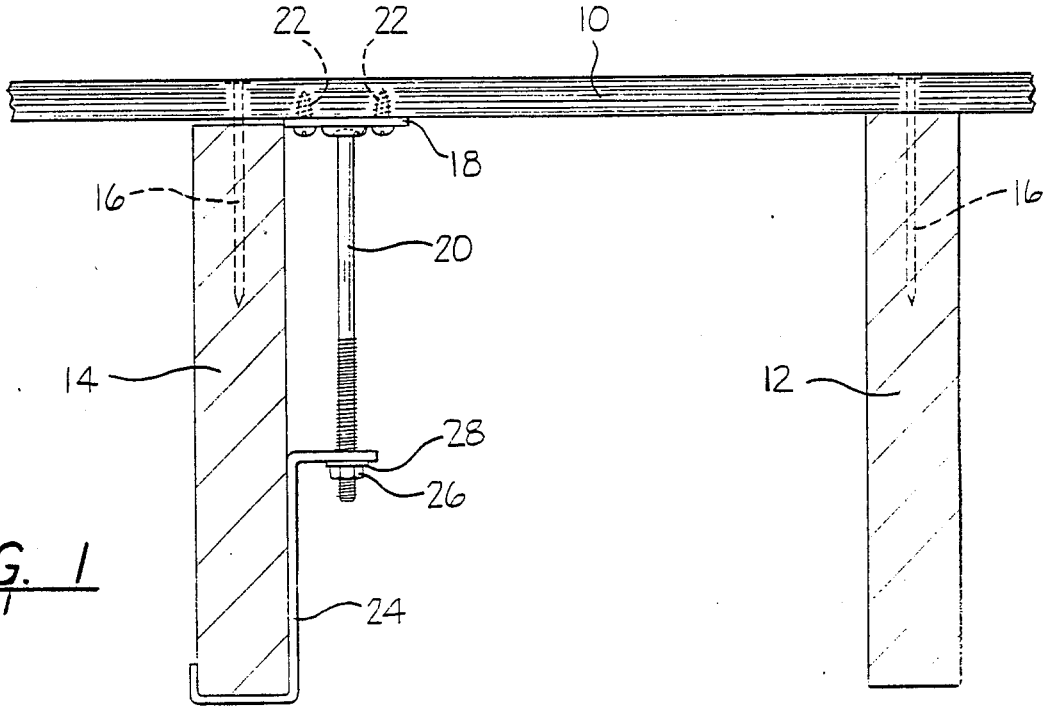
FIG. 1 is a front elevational view of a squeak eliminator of the present invention shown in use.

Referring now to FIG. 1, there is shown one embodiment of a squeak eliminator structured in accord with the present invention, as disposed in use. Shown in FIG. 1 is a portion of a floor which includes a deck 10 and a pair of subjacent floor joists 12,14. The floor deck 10 is supported in direct contact with the first joist 12 and affixed thereto by a nail 16, shown here in phantom outline. A second portion of the floor deck 10 is attached to the second joist 14 by means of another nail 16 also shown in phantom outline. It will be noted that the floor deck 10 does not rest in contact with the second joist 14 but rather, there is a gap therebetween. It is this gap that will produce a squeak and/or a spongy feel to the floor. When weight is placed on the floor deck 10 in the region of the second joist 14, the weight will drive the deck 10 against the upper surface of the joist 14 and the floor may squeak either as a result of wood rubbing the nail 16 or wood rubbing other pieces of wood.

The squeak eliminator, as illustrated in FIG. 1 includes a floor plate assembly generally comprised of a planar member 18 having a carriage bolt 20, or other such generally elongated member retained thereby and projecting therefrom. The planar member 18 is affixed to the underside of the floor deck 10 by means of screws 22, although obviously other affixing means such as nails or adhesives may be similarly employed. The squeak eliminator further includes a joist strap 24 which has a first hook shaped end configured to fit about the joist 14, distal the floor deck 10. The joist strap 24 further includes a second end which has an opening therethrough configured to receive the carriage bolt 20 or other elongated member. The squeak eliminator still further includes a nut 26 or similar attachment means which functions to join the joist strap 24 to the elongated member 20 of the floor plate assembly and to draw the planar member 18 of the floor plate assembly and the joist together so as to tighten the floor against the joist. It will also be noted from the FIG. 1 illustration that a washer in 28 is interposed between the nut 26 and the second end of the joist strap 24. This washer facilitates tightening of the nut.

Figure 2:
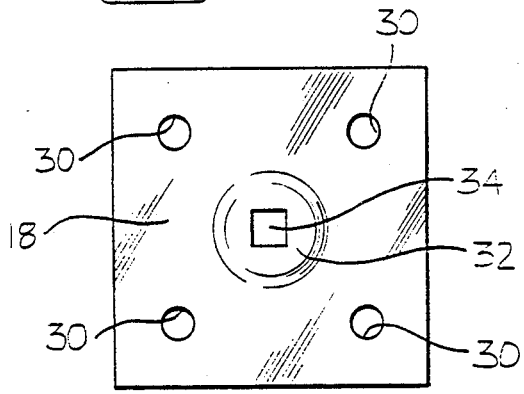
FIG. 2 is a top plan view of the planar member of the floor plate assembly of the present invention.

Referring now to FIG. 2, there is shown a top plan view of one embodiment of planar member 18 of the floor plate assembly. In the illustrated embodiment, the planar member 18 includes four holes 30 therethrough. Each hole is configured to allow the shaft of a wood screw to pass therethrough but is made small enough so as to retain the head of the screw. In this manner, the holes 30 may be used in conjunction with the screws to mount the planar member 18 onto the bottom surface of the floor. It is to be understood of course that the planar member may take other shapes and that a greater or lesser number of holes may be included and that the planar member 30 may be affixed to the floor by nails, adhesive or other such means.

The central portion of the planar member 18 includes a depressed region 32 configured to receive the head of a carriage bolt. This depressed portion also includes a generally square opening 34 therein. As is generally known to those of skill in the mechanical arts, carriage bolts have a generally cylindrical shaft with at least a portion thereof threaded and the a top most portion of the shaft proximate the bolt head is configured to be of square cross section. The square opening 34 in the planar member 18 is sized to engage and retain the square portion of the carriage bolt shaft so as to lock the bolts from turning. The planar member 18 is thus configured to retain the carriage bolt so that the bolt projects therefrom in and approximately perpendicular relationship. As utilized herein, the term "approximately perpendicular" refers to the fact that the bolt projects away from the planar member at an angle greater than 45°. This accounts for the fact that the planar member 18 may be placed at various distances from the joist and the carriage bolt 20 will accordingly contact the joist strap at angles which may not precisely equal 90°.

Figure 3:
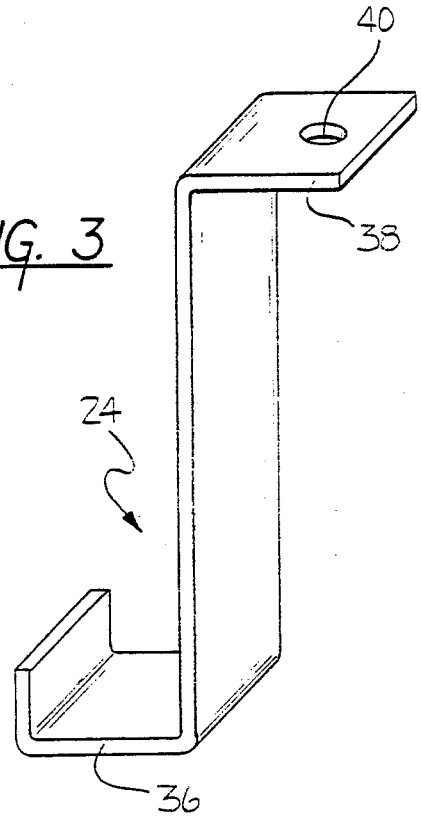
FIG. 3 is a perspective view of one configuration of joist strap of the present invention; and, FIG. 4 is a perspective view of another embodiment of joist strap of the present invention.

Referring now to FIG. 3, there is shown one embodiment of joist strap 24 structured in accord with the principles of the present invention. As will be noted from the drawing, the joist strap 24 includes a first end 36 having a generally hooklike shape and configured to engage a portion of a standard floor joist. It is to be appreciated that this hook portion maybe made in various sizes to accommodate different joist thicknesses or it may be made in one size which is large enough to fit most standardly available joists. The joist strap 24 further includes a second end 38 which, when the joist strap 24 is properly affixed to a joist, will lie in a plane generally parallel to the plane of the floor. The second end 38 includes an opening 40 therethrough configured to receive a portion of the carriage bolt or other elongated member depending from the floor plate assembly.

Figure 4:
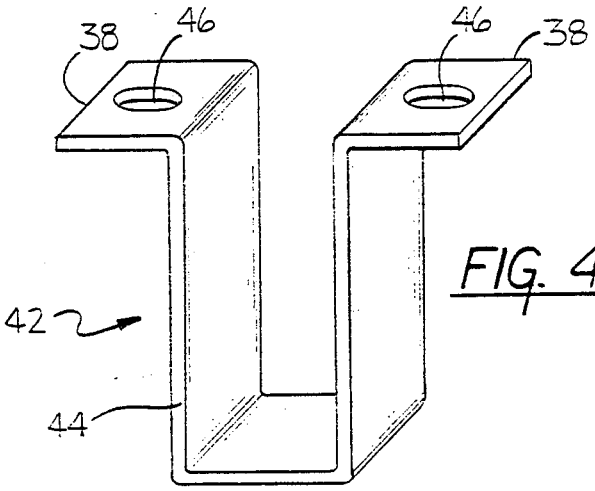

Referring now to FIG. 4 there is shown yet another embodiment of joist strap 42 having a generally U-shaped hook portion 44. The joist strap 42 of FIG. 4 further includes two second end portions 38, generally similar to those previously described. A joist strap of this type allows for engagement with two floor plate assemblies, one of which is disposed on either side of the joist and may be particularly advantageous when relatively large downward force need be applied to the floor to eliminate a squeak. The FIG. 4 joist strap exhibits still another feature of the present invention. It will be noted that the holes 46 in the second end portions 38 of the strap 42 are configured as slotted holes. This provides for easier placement of the carriage bolt with relation to the joist strap 42. Obviously, the slotted holes of this type may be similarly employed in connection with the joist strap 24 illustrated in FIG. 3. Furthermore, the holes may be oversized or slotted in the other direction to accommodate further variation in placement.

The squeak eliminator of the present invention may be fabricated from a variety of materials although for ease of fabrication and economy it will generally be preferred that the various components will be fabricated from a metallic material, particularly a ferrous material. Dimensions of the various components of the squeak eliminator will depend upon the particular size of the joist although it has been found in general that the opening of the hook portion of the joist strap should be approximately 1.5 inches and it has generally been found practical and advantageous to fabricate the joist strap to be approximately 4 inches in height from the base of the hook to the flat surface of the second end. It has been found that a joist hook having a width of approximately 1.0 inches will provide sufficient strength in most instances. The joist strap may be readily manufactured by a stamping process utilizing mild steel stock 0.12 inch in thickness.

The planar member of the floor plate assembly may be similarly fabricated by stamping from 0.12 inch steel stock and will generally be fabricated as a two inch square item having a central indented portion approximately 0.62 inches in diameter and 0.12 inches in depth. The square opening in the indented portion is preferably 0.26 inches long and accommodates a standard $\frac{1}{4}$—20×6 carriage bolt. The screw holes in the plate are preferably 7/32 inches in diameter and accommodate a No. $10\frac{3}{8}$ inch wood screw.

Other variations of the present invention are possible and contemplated within the scope hereof. For example, the joist strap and planar member of the floor plate assembly may be joined together by an elongated member passing therethrough which includes a turn buckle type arrangement along the length thereof for drawing the two members together. The joist strap may also be fabricated of a design other than that precisely illustrated. For example, the joist strap may be fabricated from stock having a round cross-section and rather than having a slot or hole drilled therethrough may include an eye portion formed by bending. These and other variations are all contemplated within the scope of the disclosure herein.

In light of the foregoing, it should be apparent that many variations and modifications of the present invention are possible. For that reason, the foregoing drawings, description and discussion are merely meant to illustrate particular embodiments of the present invention and are not meant to be limitations upon the practice thereof. It is the following claims, including all equivalents, which define the scope of the invention.

I claim:

1. A squeak eliminator for drawing a floor into contact with a subjacent joist, comprising:

a floor plate assembly including a generally planar member having means for affixing said planar member to the underside of a floor and further including a generally elongated member retained by said planar member and projecting approximately perpendicular therefrom;

a generally hook-shaped joist strap having a first end configured to be hooked about, and retainably engaged by a floor joist and a second end having an opening configured to have a portion of the length of the elongated member pass therethrough; and, attachment means operative in conjunction with the joist strap and the elongated member to retain the joist strap and the elongated member in fixed relationship and to bias the planar member and joist strap toward one another whereby the floor is urged into contact with the joist.

2. A squeak eliminator as in claim 1, wherein said planar member includes a plurality of holes therein and wherein said means for affixing the planar member comprises a plurality of screws configured to pass through said holes and operative to attach said planar member to the underside of the floor.

3. A squeak eliminator as in claim 1, wherein said generally elongated member is a carriage bolt and wherein said planar member includes an indented portion thereupon configured to receive the head of the carriage bolt and including an opening dimensioned to allow the shaft of the carriage bolt to pass therethrough.

4. A squeak eliminator as in claim 1, wherein the first end of the joist strap is generally hook shaped and is configured to engage the floor joist distal the floor.

5. A squeak eliminator as in claim 1, wherein the second end of said joist strap is generally planar and is configured to be parallel to the floor when a first end of the joist strap is engaged with the joist.

6. A squeak eliminator as in claim 1, wherein said attachment means includes a threaded fastener.

7. A squeak eliminator as in claim 1, wherein at least a portion of the elongated member is threaded and wherein the attachment means includes a nut engagable with the threading on the elongated member.

8. A squeak eliminator as in claim 1, wherein said floor plate and joist strap are fabricated from a metal.

9. A squeak eliminator for drawing a floor into contact with a subjacent joist, comprising:

a floor plate assembly comprised of a carriage bolt having a head and a shaft, a first portion of the shaft being of square cross-section and a second portion of the shaft being threaded, the floor plate assembly further including a planar member having a plurality of screw holes therein, said holes configured to permit passage of the shaft of a wood screw therethrough while retaining the head of the screw, said planar member further including an indented portion therein configured to retain the head of the carriage bolt therein and including a square opening therethrough corresponding generally to the square portion of the shaft of the carriage bolt;

a joist strap having a hook portion formed by a first end thereof, said hook portion configured to engage a floor joist, said joist strap further including a second end portion configured to be disposed generally parallel to the floor when the hook portion is engaged with the joist, said second end including an opening therethrough configured to permit passage of the carriage bolt therethrough; and a nut engageable with the threaded portion of the carriage bolt projecting through the opening in the joist strap, said nut operative in conjunction with the carriage bolt to draw planar member and second end of the joist strap toward one another so as to draw the floor into contact with the subjacent joist.

* * * * *